US009551119B2

(12) United States Patent
Tirimanna

(10) Patent No.: US 9,551,119 B2
(45) Date of Patent: Jan. 24, 2017

(54) PREFABRICATED BRIDGE

(71) Applicant: FDN CONSTRUCTION BV, Amsterdam (NL)

(72) Inventor: Dilshan Lakmal Tirimanna, Amsterdam (NL)

(73) Assignee: FDN CONSTRUCTION BV, Amsterdam (NL)

( * ) Notice: Subject to any disclaimer, the term of this patent is extended or adjusted under 35 U.S.C. 154(b) by 75 days.

(21) Appl. No.: 14/367,007

(22) PCT Filed: Dec. 18, 2012

(86) PCT No.: PCT/NL2012/000075
§ 371 (c)(1),
(2) Date: Jun. 19, 2014

(87) PCT Pub. No.: WO2013/095087
PCT Pub. Date: Jun. 27, 2013

(65) Prior Publication Data

US 2014/0345069 A1 Nov. 27, 2014

(30) Foreign Application Priority Data

Dec. 19, 2011 (NL) ..... 1039249

(51) Int. Cl.
*E01D 21/00* (2006.01)
*E01D 15/133* (2006.01)
(Continued)

(52) U.S. Cl.
CPC ..... *E01D 15/133* (2013.01); *E01D 19/10* (2013.01); *E01D 19/103* (2013.01); *E01D 21/00* (2013.01);
(Continued)

(58) Field of Classification Search
CPC ..... E01D 19/125; E01D 19/00; E01D 2/02; E01D 2/00; E01D 2101/28; E01D 19/03; E01D 19/10; E01D 21/00; E01D 2101/40; E01D 15/133
See application file for complete search history.

(56) References Cited

U.S. PATENT DOCUMENTS 2,405,335 A * 8/1946 Turner ..... E01D 2/00 404/17
3,411,167 A 4/1966 Sedlacek
(Continued)

FOREIGN PATENT DOCUMENTS

| | | |
|---|---|---|
| DE | 1 534 205 A1 | 5/1969 |
| EP | 0 113 661 A2 | 7/1984 |
| FR | 961451 A | 5/1950 |

OTHER PUBLICATIONS

International Search Report, dated Apr. 15, 2013, from corresponding PCT application.

*Primary Examiner* — Abigail A Risic
(74) *Attorney, Agent, or Firm* — Young & Thompson

(57) ABSTRACT

Bridge including a bridge deck extending in a bridge direction or longitudinal direction of the bridge, and two prefab bridge railings situated on the longitudinal side of the bridge deck, wherein the bridge deck is substantially formed by one or more slabs spanning the bridge width, wherein the bridge railing includes a lower girder provided with a bearing, particularly a bearing edge, for a longitudinal edge strip of the bridge deck.

19 Claims, 8 Drawing Sheets

(51) Int. Cl.
*E01D 19/10* (2006.01)
*E01D 101/28* (2006.01)
*E01D 101/40* (2006.01)

(52) U.S. Cl.
CPC ..... *E01D 2101/28* (2013.01); *E01D 2101/40* (2013.01)

(56) References Cited

U.S. PATENT DOCUMENTS 3,295,269 A 1/1967 Wilhelm
3,842,552 A * 10/1974 Hudson ..... E01D 2/00 14/73
3,981,601 A * 9/1976 Arai ..... E01D 19/06 14/73.1
4,300,320 A * 11/1981 Rooney ..... E01C 11/26 14/73
4,604,841 A * 8/1986 Barnoff ..... E01D 2/02 14/73
4,991,248 A * 2/1991 Allen ..... E01D 19/125 14/73
5,577,284 A * 11/1996 Muller ..... E01D 2/00 14/73
5,893,187 A * 4/1999 Fukuoka ..... E01D 19/04 14/74.5
6,904,636 B2 * 6/2005 Hwang ..... E01D 19/125 14/73
7,524,136 B2 * 4/2009 Stenger ..... E01C 7/142 14/73
2001/0039773 A1 * 11/2001 Bot ..... E01D 19/125 52/259
2004/0074022 A1 * 4/2004 Tokuno ..... E01D 2/00 14/73
2004/0074183 A1 * 4/2004 Schneider, III ..... E01D 19/125 52/334
2006/0034654 A1 * 2/2006 Sanders ..... E01C 5/08 404/40
2006/0272267 A1 * 12/2006 Mentado-Duran ..... E01D 2/00 52/693
2007/0000077 A1 * 1/2007 Wilson ..... E01D 19/125 14/73
2011/0277403 A1 * 11/2011 Peeters
2013/0061552 A1 * 3/2013 Beach ..... E01D 19/125 52/650.3

* cited by examiner

PREFABRICATED BRIDGE

BACKGROUND OF THE INVENTION

The invention relates to a bridge. The invention particularly relates to a bridge that has been built up from modules. The invention particularly relates to a bridge built up from modules placed parallel or in series. The invention particularly relates to a bridge assembled from prefab sections made of concrete or a synthetic (fibre-reinforced) composite material.

Bridges of prefab concrete elements are known. For short spans often one single concrete slab is used as deck, on the longitudinal sides of which usually steel railings are attached. Longer spans can also be realised by means of bridges with abutting girders, the deck of which is assembled from border girders and intermediate girders that are tensioned against each other in transverse direction. For longer bridge lengths such slabs or such abutting girder decks can be supported in series on intermediate supports.

In a further type of bridge pre-tensioned concrete girders form the support of a pressure layer arranged in situ. The girders with the lower flanges then extend practically against each other. Along the sides edge girders are arranged on which usually steel railings are mounted. In another type of bridge box girders are used that along the edges are connected to each other or are tensioned against each other at that location.

In larger spans the required height of the girder may very well not only be objectionable from an aesthetic point of view, it will also constitute a limitation of the height of the free passage underneath the bridge or necessitate a higher connection or intermediate support.

SUMMARY OF THE INVENTION

It is an object of the invention to provide a bridge of the type mentioned in the preamble, the deck of which can have a relatively low constructional height.

It is an object of the invention to provide a bridge of the type mentioned in the preamble, which is easy to realise.

It is an object of the invention to provide an advantageous method for making a bridge from prefab elements.

It is an object of the invention to provide a method for assembling a bridge from prefab elements that requires little time and/or effort.

It is an object of the invention to provide a bridge that can be built up from relatively short elements but nonetheless can have a relatively large length.

It is an object of the invention to provide a bridge built up from prefab sections, which sections can easily be transported to the work, particularly in standard containers, such as TEU containers.

At least one of these objects is achieved according to the invention with a bridge comprising a prefab bridge deck extending in a bridge direction or longitudinal direction of the bridge, and at least one prefab bridge railing situated on at least one longitudinal side of the bridge deck, wherein the bridge deck is substantially formed by one or more slabs, wherein the bridge railing comprises a lower girder provided with a bearing, particularly a bearing edge, for a longitudinal edge strip of the bridge deck. The bridge railing does not only form the railing, so that no steel railing or the like needs to be mounted, but also forms the support of a deck. As the railing section can cooperate in force transfer, a slimmer design of the lower section thereof forming the bearing edge for the bridge deck is possible. The bridge can be built up from a relatively small number of elements.

The bridge can be provided with a said prefab bridge railing on both longitudinal sides of the bridge deck. The one or more slabs can each be supported on both bearings, so that the slab or slabs spans/span the distance between both opposing lower girders.

In one embodiment the bridge deck is formed by one single slab. In another embodiment the bridge deck is built up from several, preferably mutually substantially similar slabs, particularly having a dimension in transverse direction of the bridge that at least substantially corresponds with the usable width of the bridge.

The bridge railing and the bridge deck can easily be made of concrete at low cost. As regards cross-section they can further be kept limited by manufacturing them of concrete of a B140 quality or higher, preferably a B200 quality or higher.

The transfer of loads from the bridge deck onto the railing is enhanced if the bridge deck is provided with a reinforcement with at least one reinforcement netting, wherein from the lower girder at the location of the bearing, connecting parts with a starter bar project upward therefrom into meshes of the reinforcement netting, wherein the starter bars are provided with a laterally projecting confining member extending over at least one reinforcement bar in the bridge deck, preferably abutting the upper side of said bar. In that way a lifting force on the bridge deck (sections) is at least substantially directly transferred via (steel) reinforcement members onto the bridge railing(s). The connection deck edge—bearing edge can thus be free from starter bars and clamps or the like projecting above the deck, as a result of which the deck has a larger usable surface.

In one embodiment the reinforcement bar extends in longitudinal direction over at least substantially the length (considered in bridge direction) of the slab in question of the bridge deck, so that it can be active with several confining members and distribution of forces is enhanced. In a simple embodiment the confining member is plate-shaped, preferably forming a circumferential flange. In that case the confining member will only need to extend over a slight height above the said reinforcement bar.

If the starter bar, at least the confining member, forms a part that after prefabrication of the bridge railing is attached to a bar anchor accommodated in the lower girder during prefabrication, the bridge railings can at that location be free of protrusions during transport and storage. The deck can be placed easily as the confining member can be arranged from above, after placing the deck, extending over the said reinforcement bar.

In one embodiment in which the height of the deck can remain limited the confining member is located recessed with its upper side, preferably sitting substantially in one plane with the upper side of the reinforcement netting, so that the concrete covering on the upper side can be the same everywhere.

Preferably, in their longitudinal edge strip, the one or more slabs of the bridge deck are provided with previously made recesses that preferably are vertically continuous and have been filled with mortar or the like after accommodation of the respective starter bars. The previously made recesses can be arranged in a longitudinal series, preferably two or more similar longitudinal series that are situated next to each other in each longitudinal edge strip.

The reinforcement bar can extend through said recess, visible to the workman who has to place the confining member over it. The recesses preferably are made during the prefabrication of the one or more slabs of the bridge deck.

The bridge railing can also comprise an upper girder, wherein the lower girder and upper girder are part of an integrally formed bridge railing. In that case the bridge railing(s) forms/form a high girder, the height being defined by the safety requirements applying to the bridge railing in question.

In an open embodiment, in the bridge railing the lower girder and the upper girder are connected to each other by bars that are integrally formed therewith. In a particular embodiment thereof in the bridge railing the bars with each other and with the upper girder and lower girder define lateral openings that have shapes that are different one from the other.

A bridge according to the invention can in case of a short bridge length have been built up with on one side or both sides an integrally formed bridge railing, option ally with one integrally formed (plate-shaped) deck section. For larger lengths the bridge railing can be built up from a number of bridge railing sections placed in line against each other in bridge direction (longitudinal direction or span direction), particularly bridge railing sections that are substantially mutually similar, that are tensioned against each other by means of tensioning elements extending through the consecutive bridge railing sections.

The bridge deck may also have been built up from several slabs having a width in bridge transverse direction that at least substantially corresponds with the usable bridge width and are placed in line against each other in bridge direction. The slabs of the bridge deck can be tensioned against each other as a result of tensioning the bridge railing sections against each other.

For the said tensioning of the railing sections against each other the lower girders can each be provided with a first longitudinal passage for a (pre-) tensioning element, extending through the first longitudinal passages situated in line with each other.

In case of said upper girder it can also be used for a continuous (pre-) tensioning element that will then extend through second longitudinal passages situated in line with each other in the upper girders.

According to further aspect the invention provides a bridge comprising a number of bridge sections situated in series in bridge direction, that each comprise a concrete bridge deck prefabricated as one unity and two, in particular concrete, bridge section railings situated on either side thereof and each prefabricated as one unity, wherein the bridge sections with the bridge section railings are placed in series against each other and are tensioned against each other by the (pre-)tensioning elements that extend through the bridge section railings and continue over the bridge length. The (pre-) tensioning elements can extend through a longitudinal passage present in an upper part of the bridge section railings, particularly in an upper girder thereof, and/or through a longitudinal passage present in a lower part of the bridge section railings, particularly in a lower girder thereof. The bridge deck of a bridge section may have been built up from several slabs, for instance two, that have been placed against each other in bridge direction and span the distance between both bridge section railings.

In this case as well the lower girder can form a bearing for the deck. In this case as well the measures according to the invention discussed in connection with the previous can be applicable.

By supporting the bridge (section) railings on the lower girder there can also be space present for transverse ribs provided at the lower side of the bridge (section) deck, for reinforcing the deck, should this be desirable in the design in question. The transverse ribs then remain within the vertical transverse profile defined by the lower girders.

According to a further aspect the invention provides a method for making a bridge from a series of prefab, preferably reinforced concrete deck sections, particularly substantially plate-shaped deck sections, and two series of prefabricated, preferably concrete railing sections, wherein the railing sections are placed in series against each other and the deck sections, that particularly each span the distance between both series of railing sections, are placed on the railing sections and attached thereto, wherein through passages in the railing sections that are in line with each other tensioning elements that extend over the bridge length are arranged in order to tension the railing sections against each other in bridge direction.

In a first further development first separate series of railing sections are made and the deck sections are subsequently placed in series on the series of railing sections and are attached thereto. More particularly the separate series of railing sections are made near the location of the bridge to be created, after which the deck sections are placed and attached to the railing sections, and subsequently the whole of railing sections and deck sections is placed in the work.

In one embodiment the railing sections are tensioned against each other prior to placing the deck sections, as a result of which moving the series of railing sections is facilitated.

In a second further development first bridge sections or bridge pieces are built up from two railing sections and one or more deck sections borne by them that particularly each span the distance between both railing sections, after which the bridge sections are tensioned against each other by means of said tensioning elements.

Preferably the tensioning elements are arranged in passages in a lower girder and/or upper girder of the railing sections. The tensioning elements can be tensioned in order to turn the girder in question into a pre-tensioned girder.

Transverse movement between the consecutive parts can easily be prevented if the railing sections and the deck sections, respectively, are connected to each other by means of dowel connections.

In one embodiment in which the railing sections are provided with bearing edges or bearing strips extending in longitudinal direction thereof, the deck sections are borne thereon with edge strips and are attached thereto by means of starter bars.

In a simple further development thereof, the deck sections are provided with holes in the edge strips, which holes are vertically continuous, the deck sections with said holes are placed on the bearing strips, wherein the upper ends of the starter bars remain below the upper opening of the holes, and the holes are filled with mortar or a similar means. Preferably after placing the deck sections the starter bars are arranged in the holes and are attached to bar anchors situated in the bearing strips, after which the holes are filled. The starter bars can be placed in the holes with laterally projecting confining members extending over reinforcement bars of the deck section that extend through the hole, preferably sitting thereon.

Preferably use is made of deck sections and railing sections of B140 concrete quality or higher, preferably B200 quality or higher.

The length of the railing sections, considered in bridge longitudinal direction, can be larger than the length of the deck sections, particularly an integer multiple thereof. This may enhance transport in containers.

According to a further aspect the invention provides a bridge according to the claims providied with this application and described in the pages that follow,, wherein from the lower girder at the location of the bearing, connecting parts with a starter bar extend upward therefrom into recesses in the bridge deck, wherein the recesses are provided with a stop member that is fixedly accommodated in the bridge deck, wherein the starter bar is provided with a laterally projecting confining member that is situated in the recess and extends over the stop member at least one reinforcement bar in the bridge deck, preferably abutting the upper side of the stop member. The stop member can be part of a sleeve that is secured in the bridge deck, wherein the sleeve preferably is continuous over the height of the bridge deck. The sleeve can have a flange as a stop member, wherein the confining member is plate-shaped, preferably forming a circumferential flange for abutting against the flange of the stop member. The starter bar, at least the confining member, can form a part that after prefabrication of the bridge railing is attached to a bar anchor that is accommodated in the lower girder during prefabrication. The recess is free of filler. In view of disassembly the recess can be closed off by means of a removable cap. The one or more slabs of the bridge deck, as stated before, can be provided with a reinforcement netting, the connecting parts with a starter bar extend upward therefrom into meshes of the reinforcement netting, wherein the stop member is formed by a reinforcement bar extending through the recess, wherein the starter bars are provided with a laterally projecting confining member extending over said reinforcement bar, preferably abutting the upper side of said bar. The reinforcement bar can extend in longitudinal direction over at least substantially the length (considered in bridge direction) of the slab in question of the bridge deck. The confining member can be plate-shaped, preferably forming a circumferential flange.

It is noted that in U.S. Pat. No. 3,295,269 structural parts are shown that can for instance be used as part of a lattice of a bridge. The structural parts are elongated and built up from series of adjacently positioned individual segments or links that on the edges extending in longitudinal direction of the structural part engage into each other and are connected to each other so as to hinge at that location, so that the structural part is able to take up a flat condition or a turned condition. The links are pressed against each other by tensioning cables extending through the edges of the links.

It is furthermore noted that in DE 1.534.205 a viaduct is shown, built up from steel parts, wherein the bridge deck is attached to longitudinal girders through the intermediary of brackets that are welded to the web of the I-shaped girders.

The aspects and measures described in this description and the claims of the application and/or shown in the drawings of this application may where possible also be used individually. Said individual aspects and other aspects may be the subject of divisional patent applications relating thereto. This particularly applies to the measures and aspects that are described per se in the sub claims.

BRIEF DESCRIPTION OF THE DRAWINGS

The invention will be elucidated on the basis of a number of exemplary embodiments shown in the attached drawings, in which.

DETAILED DESCRIPTION OF THE DRAWINGS

Figure 1:
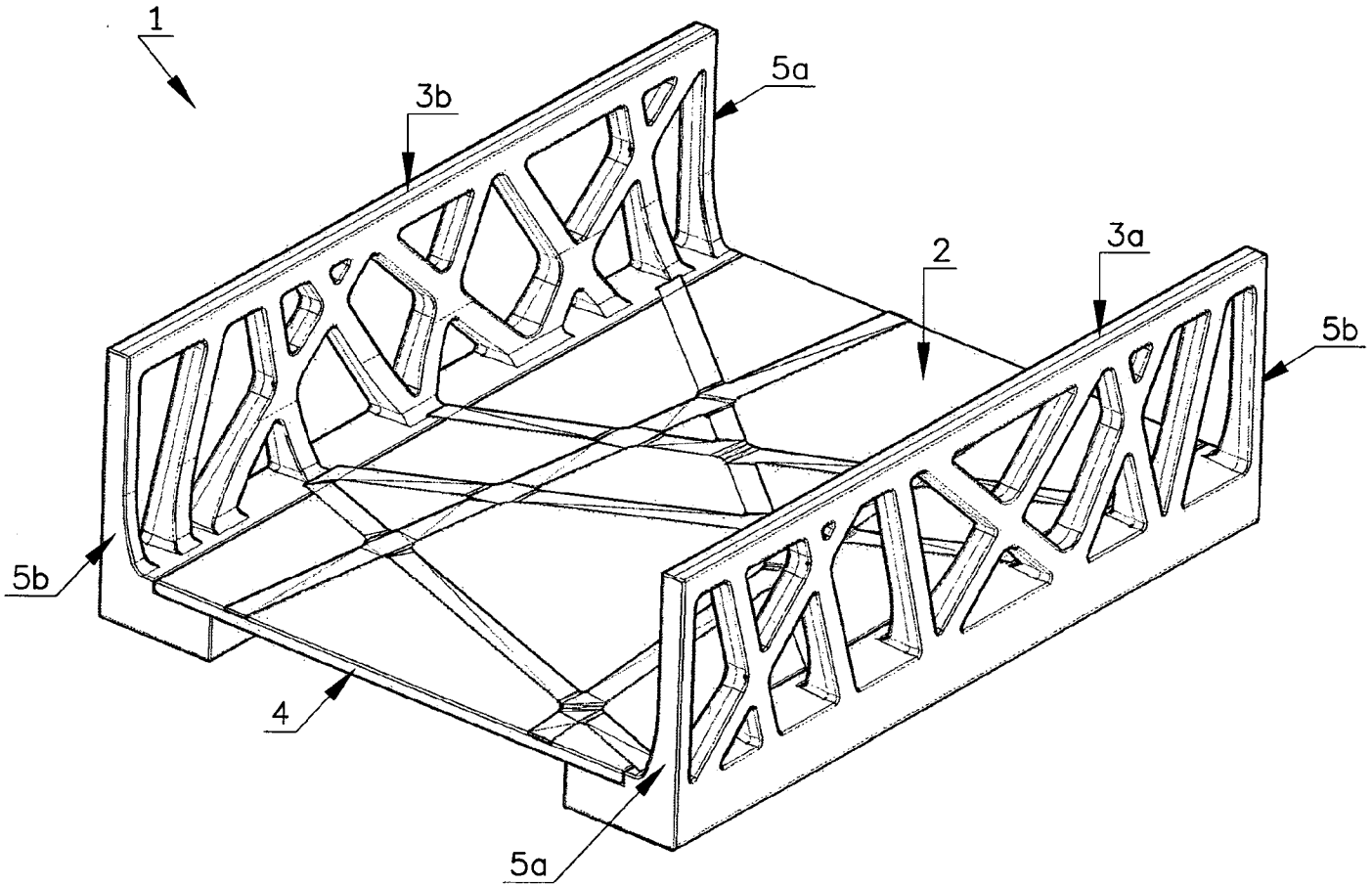
FIG. 1 shows an isometric view of a bridge section of a bridge according to an exemplary embodiment of the invention.

The bridge section or bridge piece 1 shown in FIG. 1 comprises a substantially plate-shaped (bridge section) deck 2 and two (bridge section) railings 3*a*, 3*b* attached to the longitudinal edges of the deck. The deck 2, spanning the distance between both railings, has horizontal end edge surfaces 4 that are transverse to the longitudinal direction and the railings 3*a,b* have vertical end edge surfaces 5*a*,5*b* that are transverse to the longitudinal direction.

Figure 2A:
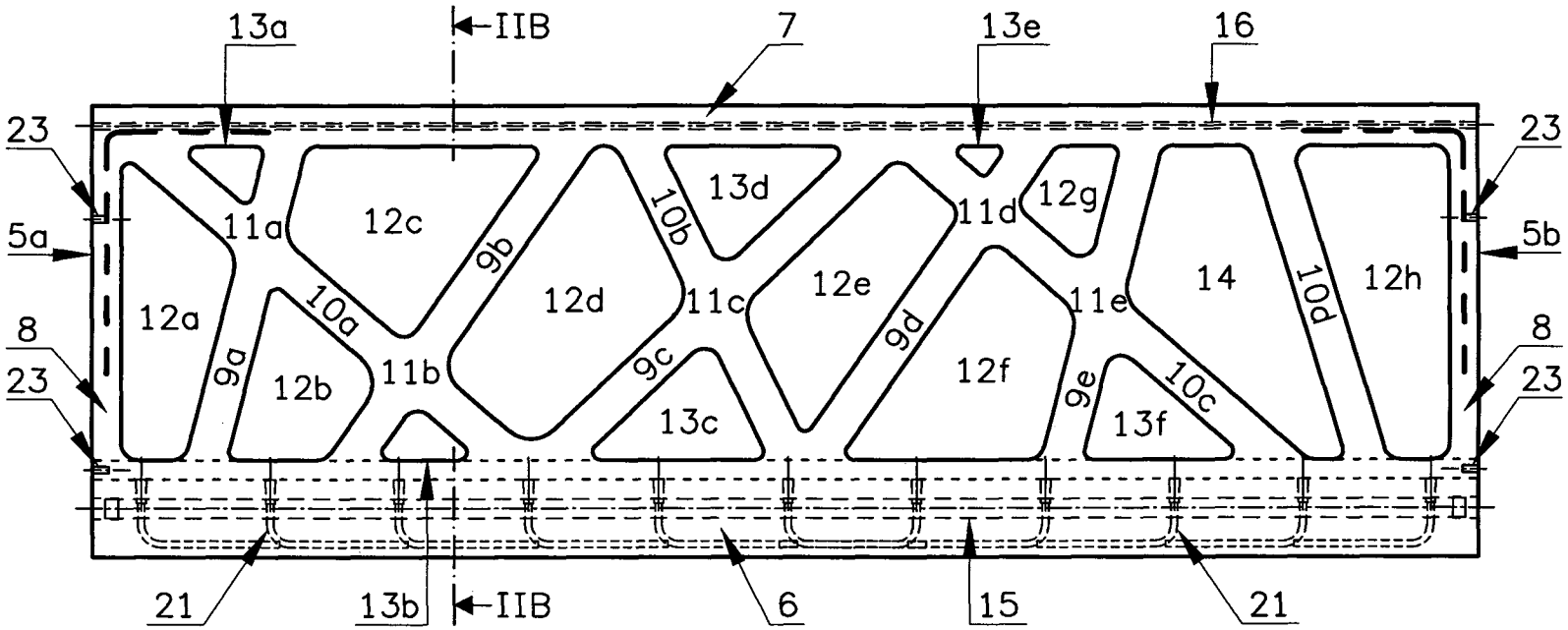
FIGS. 2A and 2B show a side view and a cross-section of a railing of the bridge section of FIG. 1 before mounting.
Figure 2B:
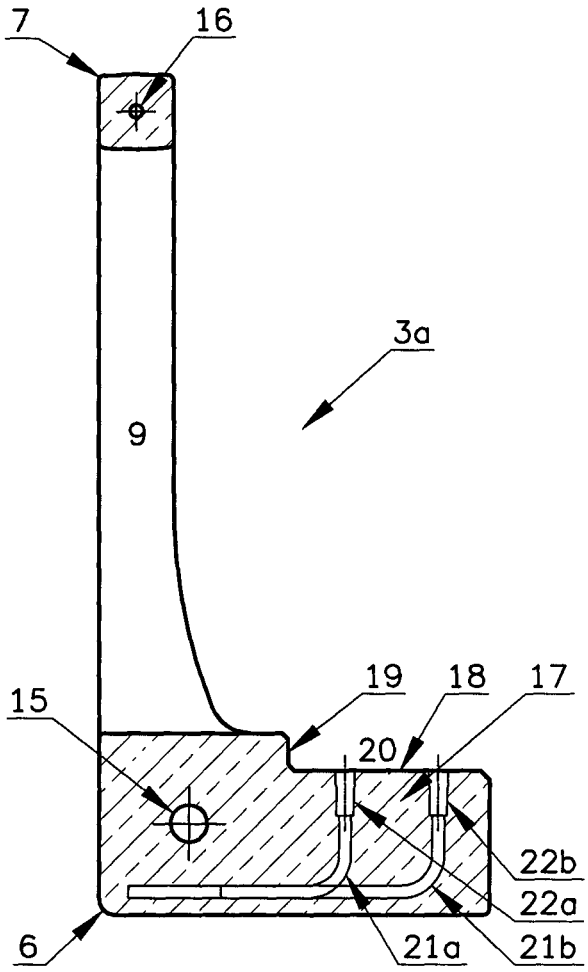

The railing 3*a,b* (for reasons of simplicity further to be called railing 3) is further shown in FIGS. 2A and 2B. It comprises, see FIG. 2A, a lower girder 6, an upper girder 7, two end posts 8 and a series of bars 9*a-e* that are inclined in the one direction and a series of bars 10*a-e* that are inclined in the opposite direction. The bars 9, 10 intersect at the location of intersections 11*a-e* and with the girders 6 and 7 form a number of holes that are not shaped similarly, in this case quadrangles 12*a-h*, triangles 13*a-f* and pentagon 14. The holes have a dimension transverse to the largest dimension thereof that is smaller than a ball having a 50 cm diameter. The upper girder 7, lower girder 6 end posts 5 and bars 9, 10 with intersections 11 are integrally formed in a mould, for instance (with the main plane horizontally) in a mould that is open at the top side, or alternatively (depending on the material) in an injection moulding process. The lower girder 6 and upper girder 7 end in the end edge surfaces 5 that also form end surfaces of the end posts 8. In the end edge surfaces 5 steel bushes 23 are furthermore provided.

FIG. 2B shows that the lower girder 6 is provided with a channel 15 that is continuous (over the full length) and has a circular cross-section and the upper girder 7 is provided with a channel 16 that is continuous (over the full length) and has a circular cross-section. The bars 9, 10 widen towards their lower ends. The lower girder 6 has a width that exceeds its height. Adjacent to the part of the lower girder 6 in which the channel 15 is situated there is a bearing part 17, in which bar anchors 21*a,b* have been accommodated during forming the railing. At their upper ends the bar anchors 21*a,b* comprise the usual sleeves 22*a*,22*b* for starter bars. With their upper edge the sleeves 22*a,b* sit in a bearing surface 18. The bearing surface 18 with step 19 forms an accommodation space 20 for the edge of a deck 2.

The deck 2 and the railings 3*a,b* are prefabricated from fibre-reinforced concrete, particularly UHSC (Ultra High Strength Concrete), in this example B200.

Figure 3A:
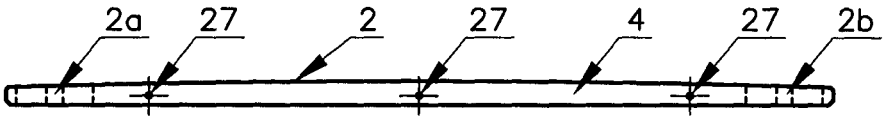
FIGS. 3A and 3B show an end view and a cross-section of a deck of the bridge section of FIG. 1 before mounting.
Figure 3B:
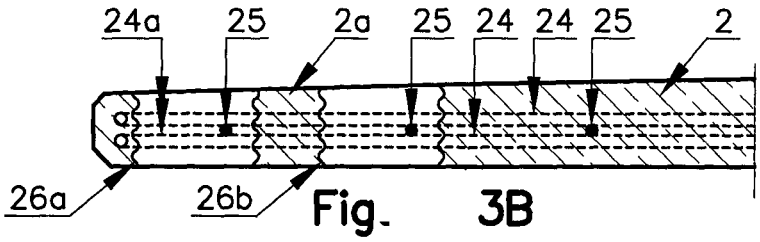

The deck 2 of FIGS. 3A,B is made by pouring the concrete in a mould and comprises reinforcement netting having a series of reinforcement bars 24 in transverse direction and a series of reinforcement bars 25 in longitudinal direction. The transverse reinforcement bars 24 have been disposed as upper reinforcement and lower reinforcement and may comprise transverse reinforcement brackets 24*a*, wherein the longitudinal reinforcement bars 25 are situated in between the said upper reinforcement and lower reinforcement, connected thereto. Steel bushes 27 have been arranged in end edge surfaces 4.

In the longitudinal edge strips 2*a*, 2*b* of the deck 2 two longitudinal series of gains (cavities for accommodating a bar connection and filling material to be arranged around it) 26*a*,26*b* have been made. Two adjacent gains 26*a,b* are aligned in transverse direction. At that location the bars of the top reinforcement and bottom reinforcement form horizontal brackets 24*a*, which with a curve over 180 degrees run around the outermost gain 26*a*. The two outermost longitudinal reinforcement bars 25*a,b* extend through the series of gains 26*a* and through the series of gains 26*b*, respectively, through the half of the gain in question that faces away from the deck longitudinal side.

Below a method of assembling a bridge built up from several bridge sections is described.

After manufacturing the decks 2 and railing pairs 3*a,b*, are transported from the plant to the work. When the lengths of decks and railings are appropriately selected this can for instance be done in 20 ft TEU containers. The length of the railings can then be between 3 and 5 m. The deck can in that case be divided in bridge direction, for instance in deck sections having a dimension in bridge direction of half the length of the railing, so that said deck sections can be accommodated in the container with their width direction in the longitudinal direction thereof. An example is: railings having a length of 4 m and deck sections having a length of 2 m and a span width of 4 m.

Figure 4A:
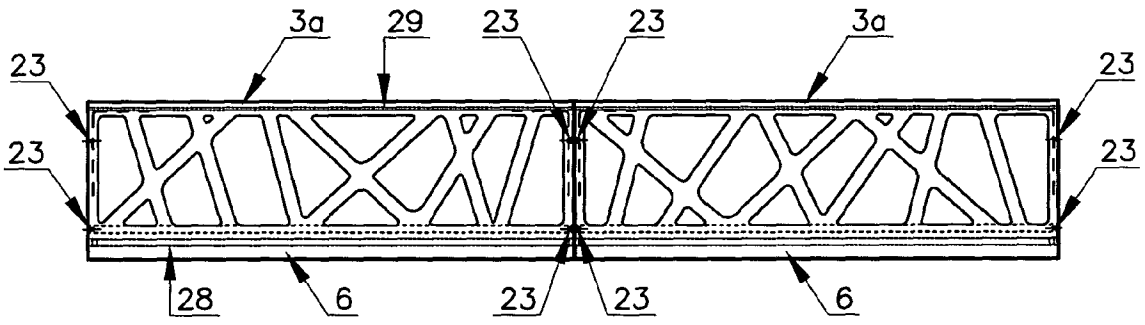
FIGS. 4A-C show successive mounting steps in making a bridge using the railings of FIGS. 2A, B and decks of FIGS. 3A, B.

The railings 3*a* are placed in a series at the work, with the end edge surfaces 5 against each other while placing dowels in the bushes 23 placed in line with each other. Subsequently a cable 28 built up from several strands of cable is passed through the channel 15 and a cable strand 29 is passed through the channel 16 and they are both (pre)tensioned as desired. At the location of their end surfaces 5 the railings 3*a* are then tensioned against each other and as it were form one manageable unit, see FIG. 4A. The same will be done for the railings 3*b*. In this example only two railing sections are shown, it will be understood that the series of railing sections can also comprise more than two railing sections. In both end surfaces 5 situated at the ends of the series of railing sections recesses—not shown—are present for accommodation of tensioning anchors 50, 51. Said recesses can be filled after the bridge has been placed.

Subsequently, near the location of the bridge to be created, both railing series are placed at the wanted mutual distance and the decks 2 are placed one by one in between them. Each deck will then come to rest on the bearing surfaces 18 with its longitudinal edge strips 2*a,b* and namely such that the gains 26*a,b* will become vertically aligned with the sleeves 22*a,b*.

Figure 4B:
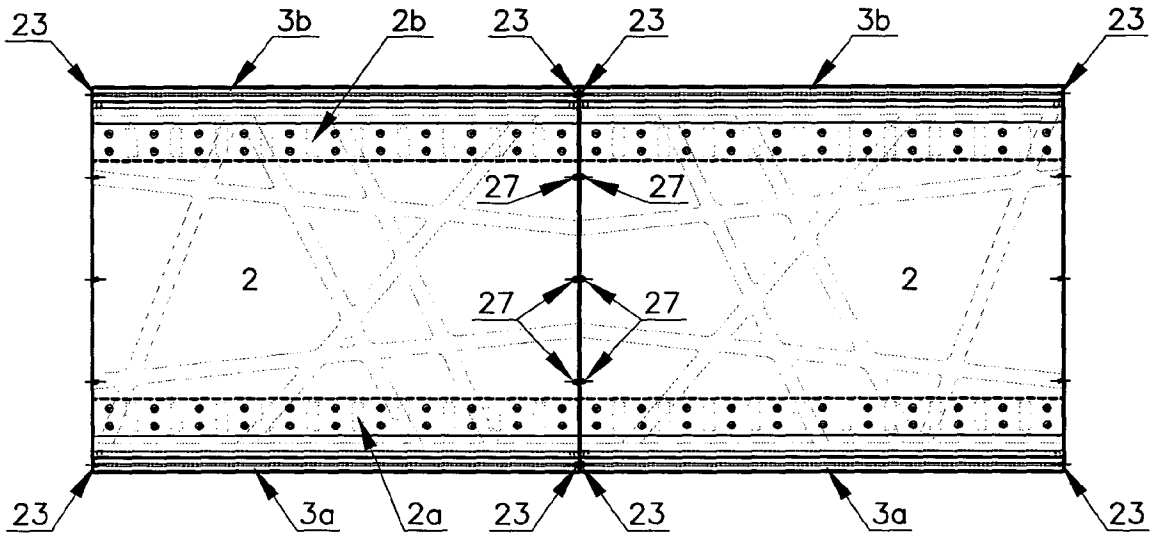

Subsequently the next deck 2 is placed, with an end edge surface 4 against the end edge surface 4 of the deck 2 that has already been placed, while placing dowels in the bushes 27 in the end edge surfaces 4 placed in line with each other, see FIG. 4B.

Figure 4C:
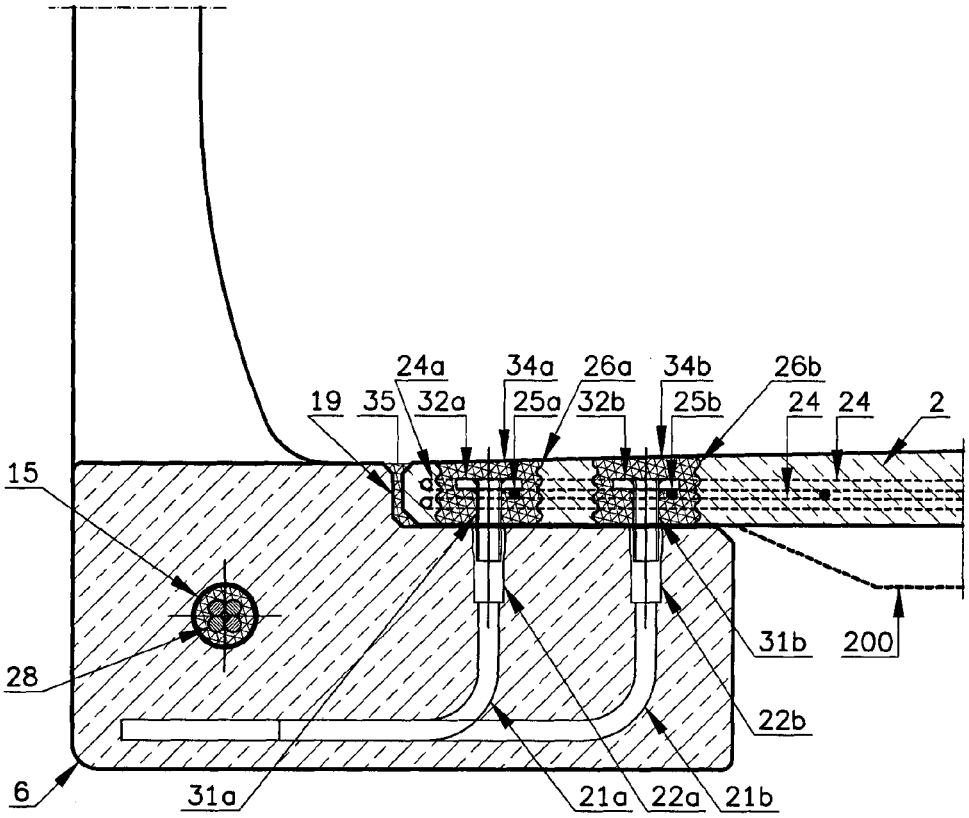

After all decks 2 have been placed and form a continuous surface the starter bars 30*a,b* are placed from above into the sleeves 22*a,b*, FIG. 4C. The starter bars 30*a,b* are short and comprises a bolt member (threaded end) 31*a,b* and a confining plate member 32*a,b* that is transverse thereto and has a thickness that does not exceed the thickness of the bars 25*a,b*.

The confining plate member 32*a,b* is circular, concentric to the bolt member 31*a,b*. The bolt member 31*a,b* is then screwed into the sleeve 22*a,b* until the confining plate member 32*a,b* comes to rest on the bar 25*a,b* extending through the gain 26*a,b* in question. The upper surface of the confining plate member 32*a,b* does not project above the uppermost transverse reinforcement bracket 24*a* at that location. Then the gains 26*a,b* are filled as shown in FIG. 4C with mortar 34*a,b* of the same quality as the concrete used for the deck and railing, and the joint between the deck longitudinal edge and step 19 is filled with epoxy mortar 35. The thread on the bolt member 31*a,b* enhances adhesion. If so desired the pre-tension is increased in the tensioning elements 28, 29.

In FIG. 4C it is indicated that within the vertical space defined by the lower girder 6 there is room for transverse reinforcement ribs 200 that do not project downward below the lower girder 6.

Figure 5A:
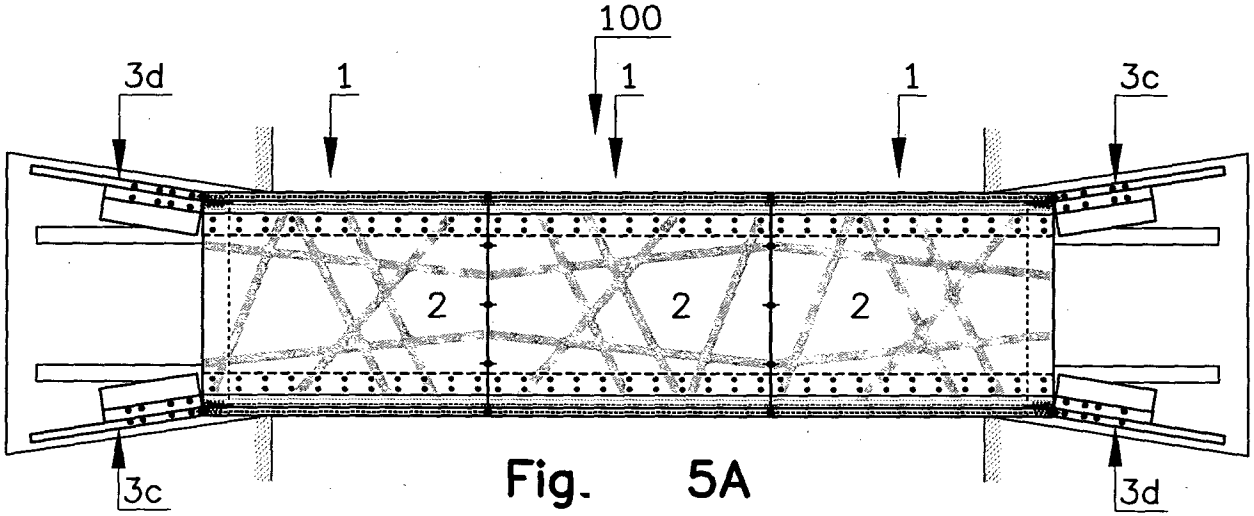
FIGS. 5A and 5B show a top view and a side view, respectively, of a finished bridge according to the exemplary embodiment.
Figure 5B:
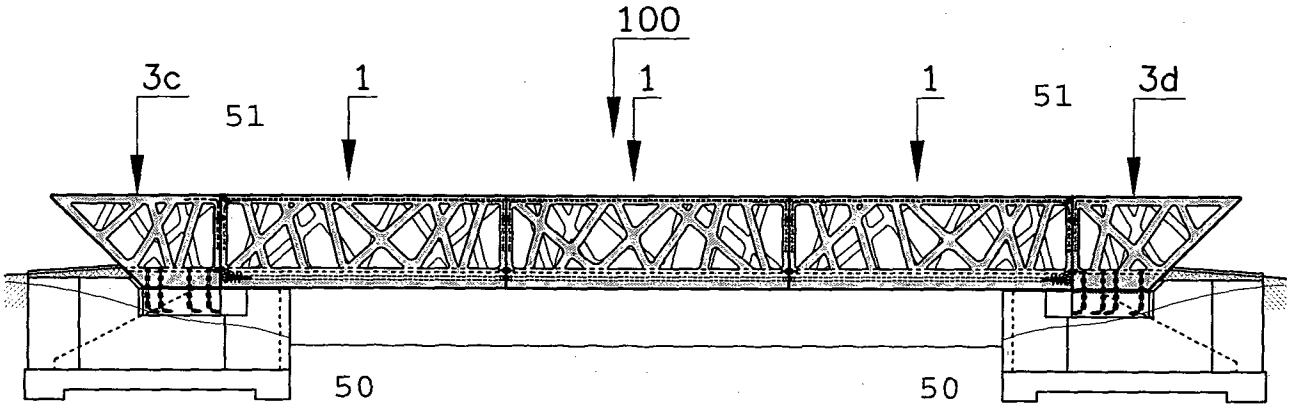

After hardening the whole of series of railings 3*a,b* and decks 2 forming a bridge can be picked up by a crane and placed at the desired prepared location, for instance having the bridge set-up 100 of FIGS. 5A and 5B as a result, wherein also end railing sections 3*c,d* have been provided.

Figure 6:
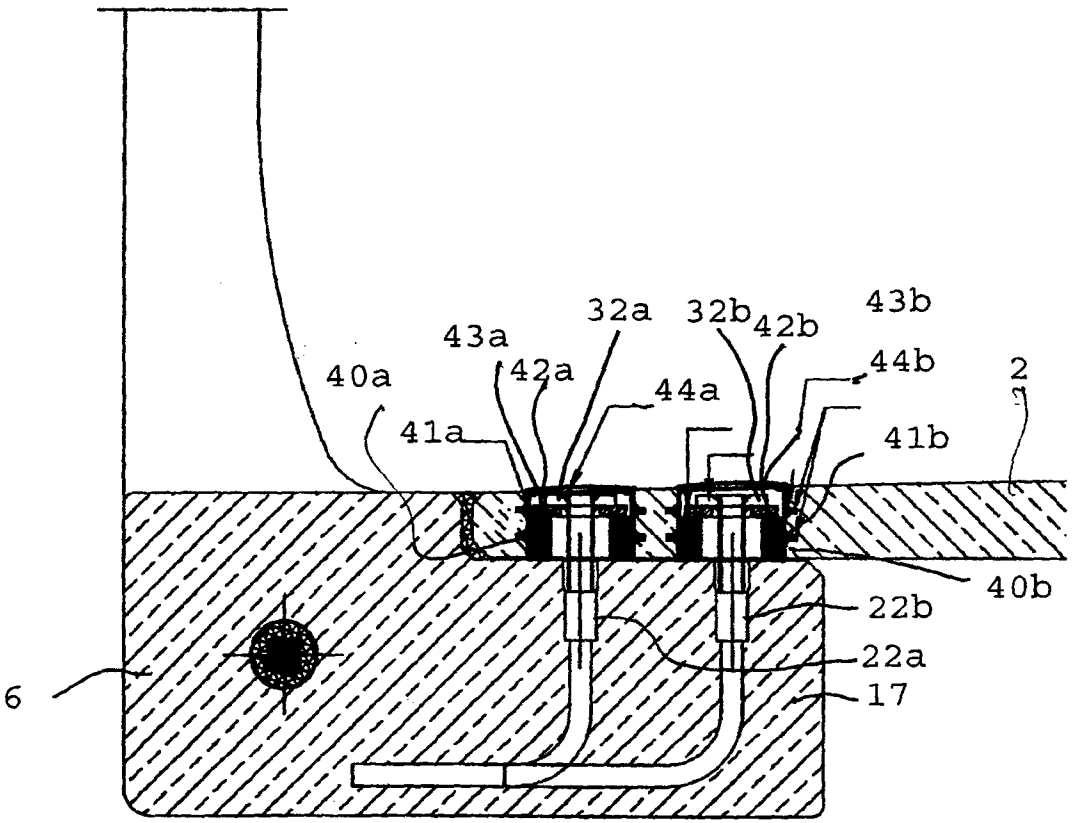
FIG. 6 shows a view corresponding with FIG. 4C of an alternative way to attach a bridge deck to a bridge railing in another exemplary embodiment of a bridge according to the invention.

In FIG. 6 an embodiment of the connection of the deck 2 with the bearing section 17 of the lower girder 6 is shown. In continuous holes 40*a,b* that have been made on locations that can be compared with the gains 26*a,b*, steel sleeves 41*a,b* have been arranged, which are anchored in the concrete by rings welded thereto. The sleeves 41*a,b* are provided with an internal shoulder 42*a,b*. The starter bars 30*a,b*, just like in FIG. 4C, are screwed into the sleeves 22*a,b*, but now until the confining plate member 32*a,b* is tensioned against the shoulder 42*a,b*, with the intermediary of a steel intermediate ring 43*a,b*. The cavity within the sleeves 41*a,b* is upwardly covered by caps 44*a,b*. In this embodiment the starter bar remains free of filler, so that after removal of the caps 44*a,b* the starter bar can be removed again. This way of attaching a deck to a bridge railing makes it possible to easily disassemble the bridge after use and transport it elsewhere for storage or different use.

In the method of building the bridge discussed above, parallel series of bridge section railings are made first. Alternatively the bridge can be built in series in complete bridge pieces or bridge sections, wherein each bridge piece, such as the one of FIG. 1, comprises two railing sections and one or more deck sections borne by them. The bridge pieces are placed against each other and then tensioned against each other with the tensioning elements. After that the bridge can be placed in the work.

If the bridge does not need to be longer than can be achieved by means of one pair bridge section railings and one or more deck sections, the deck sections can be placed and attached to both bridge section railings in the manner described above, after which the bridge consisting of one bridge section can be put in its place in the work. The tensioning elements can be utilised for pre-tensioning.

Figure 7:
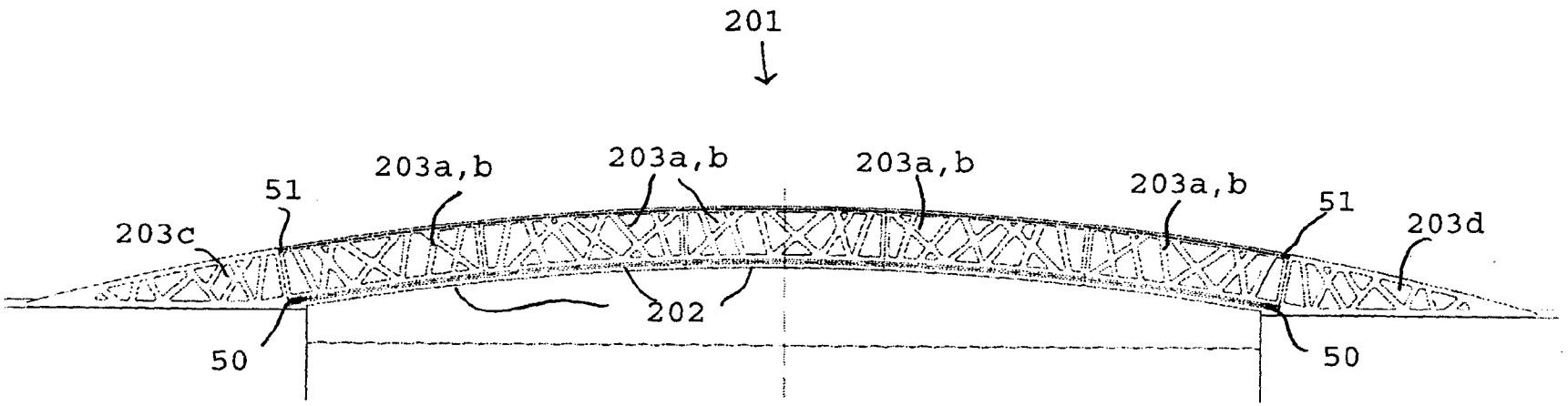
FIG. 7 shows a view of an exemplary embodiment of a bridge according to the invention in an arched shape.

In FIG. 7 an arched bridge 201 is depicted which is made in a manner comparable to the bridge 100, however now with railing sections 203*a,b* and decks 202 that are slightly curved in bridge direction/span direction.

The above description is included to illustrate the operation of preferred embodiments of the invention and not to limit the scope of the invention. Starting from the above explanation many variations that fall within the spirit and scope of the present invention will be evident to an expert.

The invention claimed is:

1. A bridge, comprising:

a bridge deck extending in a bridge direction or longitudinal direction of the bridge; and two prefab bridge railings made of concrete and situated on either longitudinal side of the bridge deck, respectively, wherein the bridge deck comprises opposite longitudinal edge strips and is substantially formed by one or more slabs, wherein each bridge railing comprises a lower girder provided with a bearing for interfacing with a longitudinal edge strip of the bridge deck, and wherein the one or more slabs each span an entire distance between the two bridge railings, and the longitudinal edge strips are attached to the bearings.

2. The bridge according to claim 1, wherein from the lower girder at the location of the bearing connecting parts with a starter bar extend upward therefrom into recesses in the bridge deck, wherein the recesses are provided with a stop member that is fixedly accommodated within the concrete of the bridge deck, and wherein the starter bar is provided with a laterally projecting confining member that is situated in the recess and extends over the stop member in the bridge deck and abuts the upper side of the stop member.

3. The bridge according to claim 2, wherein the stop member is part of a sleeve that is secured in the bridge deck where the sleeve has a flange as a stop member, and wherein the confining member is plate-shaped and forms a circumferential flange for abutting against the flange of the stop member.

4. The bridge according to claim 2, wherein the recess is free of filler.

5. The bridge according to claim 2, wherein the recess can be closed off by means of a removable cap.

6. The bridge according to claim 2, wherein the one or more slabs of the bridge deck are provided with a reinforcement netting, the connecting parts with a starter bar extend upward therefrom into meshes of the reinforcement netting, wherein the stop member is formed by a reinforcement bar extending through the recess, wherein the reinforcement bar extends in longitudinal direction over at least substantially the length (considered in bridge direction) of the slab in question of the bridge deck, and wherein the starter bars are provided with a laterally projecting confining member extending over the said reinforcement bar and abutting the upper side of said bar.

7. The bridge according to claim 6, wherein the confining member is plate-shaped, forming a circumferential flange.

8. The bridge according to claim 2, wherein the starter bar, at least the confining member, forms a part that after prefabrication of the bridge railing is attached to a bar anchor accommodated in the lower girder during prefabrication.

9. The bridge according to claim 6, wherein the confining member is located vertically recessed with its upper side, sitting substantially in one plane with the upper side of the reinforcement netting.

10. The bridge according to claim 2, wherein the one of more slabs of the bridge deck are provided, within corresponding longitudinal edge strips, with previously made recesses that are vertically continuous and have been filled after accommodation of the respective starter bars.

11. The bridge according to claim 1, wherein each bridge railing also comprises an upper girder, wherein the lower girder and upper girder are part of an integrally formed bridge railing where in each bridge railing the lower girder and the upper girder are connected to each other by bars that are integrally formed therewith, wherein in the bridge railing the bars with each other and with the upper girder and lower girder define lateral openings that have shapes that are different one from the other and comprise triangular and quadrangular shapes.

12. The bridge according to claim 1, wherein each bridge railing is built up from a number of bridge railing sections placed in line against each other in bridge direction, that are tensioned against each other by means of tensioning elements extending through the consecutive bridge railing sections.

13. The bridge according to claim 12, wherein the bridge deck is built up from several slabs that are placed in line against each other in bridge direction, and wherein the slabs of the bridge deck are tensioned against each other as a result of tensioning the bridge railing sections against each other.

14. The bridge according to claim 1, wherein the lower girder is provided with a first longitudinal passage for a (pre-)tensioning element, and wherein a (pre-)tensioning element that is continuous over the bridge length is arranged through the first longitudinal passages that are in line with each other.

15. The bridge according to claim 1, wherein top portions of the consecutive bridge railing sections are provided with second longitudinal passages that are in line with each other, said second longitudinal passages having arranged therein a (pre-)tensioning element that is continuous over the bridge length.

16. A bridge, comprising:

a plurality of bridge sections situated in series in bridge length, each of the bridge sections including a concrete deck prefabricated as one unity, and two concrete bridge section railings situated on either side thereof and each prefabricated as one unity, wherein the bridge sections with the bridge section railings are placed in series against each other and are tensioned against each other by first and second (pre-)tensioning elements that extend through the bridge section railings and continue over the bridge length, wherein the first (pre-)tensioning elements extend continuously over the bridge length through a first longitudinal passage, an entirety of said first longitudinal passage located in an upper part of the bridge section railings in an upper girder of the bridge section railings, wherein the second (pre-)tensioning elements extend continuously over the bridge length through a second longitudinal passage, an entirety of said second longitudinal passage located in a lower part of the bridge section railings in a lower girder thereof, and wherein the lower girder forms a bearing for the deck.

17. A method for making a bridge from a series of prefab reinforced concrete, substantially plate-shaped deck sections, and two series of prefab concrete railing sections, comprising:

placing railing sections in series against each other; and placing the deck sections, that each span an entire distance between both series of railing sections, on the railing sections and attached thereto, wherein through passages in the railing sections that are in line with each other tensioning elements that extend over the bridge length are arranged in order to tension the railing sections against each other in bridge direction, and wherein first separate series of railing sections are made and the deck sections are subsequently placed in series on the series of railing sections and are attached to the railing sections.

18. The method according to claim 17, wherein the railing sections are tensioned against each other prior to placing the deck sections.

19. A method for making a bridge from a series of prefab reinforced concrete, substantially plate-shaped deck sections, and two series of prefab concrete railing sections, comprising:

placing the railing sections in series against each other; and placing the deck sections, that each span an entire distance between both series of railing sections, on the railing sections and attached thereto, wherein through passages in the railing sections that are in line with each other tensioning elements that extend over the bridge length are arranged in order to tension the railing sections against each other in bridge direction, and wherein first bridge sections or bridge pieces are built up from two railing sections and one or more deck sections borne by them that span the distance between both railing sections, after which the bridge sections are tensioned against each other by means of said tensioning elements.

* * * * *